US006209757B1

(12) United States Patent
Dumont

(10) Patent No.: US 6,209,757 B1
(45) Date of Patent: Apr. 3, 2001

(54) SQUEEZABLE MIXING AND DISPENSING CONTAINER HAVING REMOVABLE ATTACHABLE SUPPLY VESSELS

(76) Inventor: Charles Dumont, 8925 Collins Ave. Apt. 12-, Miami, FL (US) 33154

( * ) Notice: Subject to any disclaimer, the term of this patent is extended or adjusted under 35 U.S.C. 154(b) by 0 days.

(21) Appl. No.: 09/572,403

(22) Filed: May 16, 2000

(51) Int. Cl.[7] ..... B65D 83/00; B65D 37/00

(52) U.S. Cl. ..... 222/145.6; 222/145.5; 222/207

(58) Field of Search ..... 222/145.6, 145.5, 222/207

(56) References Cited

U.S. PATENT DOCUMENTS

| | | | | |
|---|---|---|---|---|
| 79,689 | * | 7/1868 | Rottanzi | 222/145.5 X |
| 2,876,935 | * | 3/1959 | Lindberg | 222/145.5 X |
| 3,200,995 | * | 8/1965 | Gangwisch | 222/145.5 X |
| 3,217,931 | * | 11/1965 | Farrar et al. | 222/145.5 X |
| 3,246,807 | * | 4/1966 | Micallef | 222/207 |
| 3,347,420 | * | 10/1967 | Donoghue | 222/207 X |
| 3,581,953 | * | 6/1971 | Donoghue | 222/207 |
| 3,760,986 | * | 9/1973 | Castner et al. | 222/145.5 X |
| 4,143,797 | * | 3/1979 | Reed | 222/207 |

* cited by examiner

*Primary Examiner*—Kenneth Bomberg
(74) *Attorney, Agent, or Firm*—Siemens Patent Services, LC

(57) ABSTRACT

A dispensing container which stores two or more separated fluids and blends the fluids when dispensing. The container includes a storage bottle for containing the first fluid and an interior auxiliary vessel for containing a second fluid. The auxiliary vessel is configured as a closure closing the open storage area of the storage bottle by threading thereto, and forms a mixing chamber above the storage bottle and auxiliary vessel. The mixing chamber has first check valves preventing backflow into the storage area of the bottle and second check valves preventing backflow into the auxiliary vessel. Preferably, the check valves are flaccid membrane valves. Optionally, agitating balls are provided in the mixing chamber. In another option, squeeze resistant compression members are placed inside the storage bottle to transfer pressure from squeezing to the interior auxiliary vessel. In still another option, dispensing container has at least one and optionally several recharging vessels. The storage bottle and interior auxiliary vessel have alignable ports enabling the latter to be recharged by a recharging vessel, which has a nozzle which penetrates the aligned ports.

12 Claims, 3 Drawing Sheets

SQUEEZABLE MIXING AND DISPENSING CONTAINER HAVING REMOVABLE ATTACHABLE SUPPLY VESSELS

REFERENCE TO RELATED APPLICATION

BACKGROUND OF THE INVENTION

1. Field of the Invention

The present invention relates to containers which blend fluent materials stored in separate chambers when dispensing these materials. More particularly, the invention sets forth a container which has plural separate fluid compartments and a resiliently flexible wall for enabling a user to discharge the contents of both compartments by squeezing the container. The novel dispensing container finds application wherever fluid materials must be blended and dispensed in quantities appropriate for individual consumers. For example, the container may be utilized by consumers to store and dispense personal care products such as shampoo and hair conditioner, cooking products such as sweeteners and colorants, and food products such as oil and vinegar for preparing salad dressings, among others. Alternatively, the container may be utilized in industrial, commercial, institutional, medical, and scientific applications to blend active ingredients with carrier fluids, or to blend ingredients which would interact on contact with one another. The fields which may benefit from the invention are many and diverse.

2. Description of the Prior Art

It is necessary from time to time to dispense several dissimilar fluent substances which must be separated from one another prior to being utilized, yet blended when utilized. Two substances separately stored usually require special measures to assure that they be fully blended or mixed together. Dispensing of two separate substances is somewhat time consuming. Furthermore, metering and dispensing, if performed separately, may expose one or both substances to contact with the air, airborne contaminants, light, or other detrimental influences.

Another aspect of containers, especially of containers having plural compartments or fluid storing vessels, is that in many cases, it is not feasible to coordinate depletion of separate fluids as both are discharged. That is, it is frequently the case that one fluid is depleted while a usable quantity of another fluid yet remains. To this end, it would be desirable to provide a container which accommodates connection of a separable vessel containing one of the fluids, for renewing one of the fluids.

It is convenient and effective to store, blend, and dispense several substances from a single container in a manner assuring that plural contents be separated until the point in time at which they are used. The prior art has proposed containers which dispense plural contents. An example is seen in U.S. Pat. No. 3,850,346, issued to James E. Richardson et al. on Nov. 26, 1974. The subject dispenser of Richardson et al. is hand squeezed to dispense fluids. Richardson et al. sets forth a valve to control discharge of fluids. However, this valve is not similar to the check valve of the present invention. Also, there is no closed mixing chamber with agitating balls, as seen in the present invention. There is no teaching in Richardson et al. of in situ recharging an internal vessel.

U.S. Pat. No. 4,978,033, issued to Sen H. Chou on Dec. 18, 1990, describes a pressurized dispensing container having a bladder which receives pressurized propellant gasses. The bladder is internal to the container. By contrast, in the present invention, the container is squeezed by hand to develop propulsive pressures. The device of Chou lacks check valves and blending apparatus of the present invention. Also, there is no provision for in situ recharging of the inner vessel, as seen in the present invention.

U.S. Pat. No. 3,217,931, issued to Richard E. Farrar et al. on Nov. 16, 1965, describes a multicompartmented dispenser. The device of Farrar et al. lacks check valves, a mixing chamber, and in situ recharging of the inner vessel, all being features of the present invention.

U.S. Pat. No. 4,585,149, issued to Karl H. Zulauf on Apr. 29, 1986, describes a hand squeezable container which incorporates a rotatable valve for adjusting relative proportions of dispensed fluids. This valve is unlike the automatically acting, unidirectional check valve of the present invention. Zulauf further lacks the mixing chamber with agitating balls and in situ recharging features of the present invention.

U.S. Pat. No. 4,673,107, issued to Gerhard Obrist on Jun. 16, 1987, shows a dosing dispenser incorporating two manual valves disposed in series. By contrast, the present invention has one or more automatically acting unidirectional check valves. Where more than one check valve is provided, they are disposed in parallel.

U.S. Pat. No. 5,328,056, issued to Bernard Schneider et al. on Jul. 12, 1994, describes a dispensing tube which dispenses plural creamy or pasty fluids. The device of Schneider et al. lacks the mixing chamber and agitating balls, check valves, and in situ recharging of the present invention.

U.S. Pat. No. 5,647,510, issued to Wilhelm A. Keller on Jul. 15, 1997, illustrates a metering and proportioning device having a collapsible cartridge. The device of Keller lacks the squeezable outer container, mixing chamber, check valves, and in situ recharging of the present invention.

The various devices of the prior art typically incorporate much more complex design than is seen in the present invention. By contrast, the present invention can be formed in as few as three or four pieces including a cap.

None of the above inventions and patents, taken either singly or in combination, is seen to describe the instant invention as claimed.

SUMMARY OF THE INVENTION

The present invention provides a hand held, squeeze action dispensing container or dispenser which is suitable for enabling consumers to blend and dispense many different fluids. The novel container has a storage receptacle in the form of a jar or bottle open at one end, and threads or other engagement structure for securing a cap which bears a discharge nozzle. The storage receptacle has an associated removable internal vessel. The internal vessel contains a second fluid which may interact with the first fluid contained within the container, or which may be a carrier fluid, a propellant, such as pressurized gas, or which may serve some other purpose. The internal vessel and the space within the storage receptacle surrounding the vessel each store one fluid. The fluids are segregated in their respective storage areas until the user wishes to dispense them as a blended mixture. The lateral wall of the storage receptacle is flexible and preferably resilient, so that squeezing the container ejects the respective fluids from the receptacle and the associated vessel. The novel container mixes or blends ejected fluids in a mixing chamber prior to discharging the same as a blended mixture. The mixing chamber is isolated from the outside atmosphere, so that the mixed fluids are protected from potential contamination.

Ability to remove the internal vessel leads to advantages including economies of manufacture. Firstly, the novel container can be fabricated by utilizing pre-existing bottles and jars, thereby avoiding retooling for one of the component parts. Another economic advantage is the ability to produce the novel container by molding as few as three or four separate component parts, including a cap, from readily recyclable plastics. A further advantage is that both fluids can be renewed as desired. Therefore, mismatches in quantity between propellant and the fluid being dispensed can be overcome. Both the fluid being dispensed and the propellant can independently, and at any time, be renewed as required. This feature enables usage of the container to continue with minimal regard for depletion of either one of the fluids being dispensed.

Several features improve the novel container over the prior art. One is incorporation of check valves located between the storage areas and the mixing chamber. These check valves prevent backflow of blended fluids, which could cause cross contamination of stored unmixed fluids. The check valves also assure that blended fluids will remain in the mixing chamber to be discharged. Preferably, the check valves are of the flaccid membrane type, which are inexpensive to fabricate and require no high precision moving parts.

An optional second important feature is that the internal vessel can be recharged without removing it from the container. An auxiliary vessel can be mated to the internal vessel to transfer new fluid from the former to the latter.

An optional third feature of the invention is incorporation of members which transfer pressure from the outer wall of the container to the internal vessel.

Accordingly, it is an object of the invention to provide a hand held dispenser which blends and dispenses plural fluids which must be stored separated from one another.

Another object of the invention is to provide a container which can store plural fluids separately from one another and blend the same when dispensing the fluids.

Still another object of the invention is to provide a hand held fluid dispenser which has a removably attachable auxiliary vessel, and which fluid dispenser receives fluid from the auxiliary vessel as well as from its own storage receptacle.

It is another object of the invention that the container have check valves preventing backflow of mixed fluids into the supply of each unmixed fluid.

It is a further object of the invention to provide a mixing chamber for mixing fluids, which mixing chamber is isolated from the outside atmosphere.

Yet another object of the invention is to provide apparatus enabling standard dispensers to be readily converted from single fluid operation to blending and dispensing operation.

An additional object of the invention is that the dispenser be manufactured by molding techniques, and that discarded dispensers be readily recyclable.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
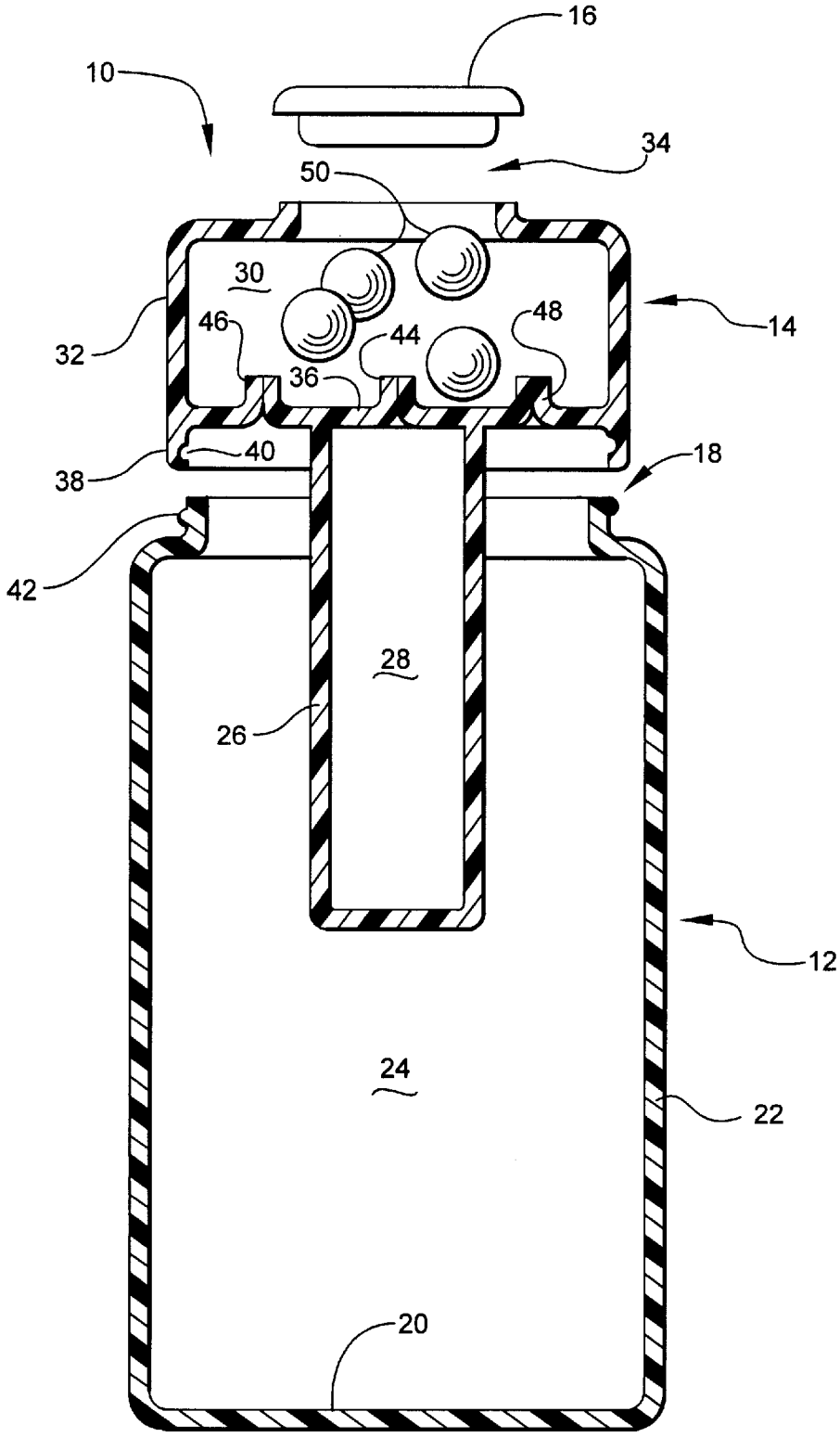
FIG. 1 is an exploded, side elevational view of one embodiment of the invention, shown partially in cross section.

The present invention is a dispensing container 10 capable of storing fluids separately, and of blending and dispensing these fluids immediately prior to dispensing. Container 10 comprises three principal separable components comprising a storage bottle 12, a combined auxiliary vessel and closure for storage bottle 12, hereinafter referred to as auxiliary vessel 14, and a cap 16 which closes the top of auxiliary vessel 14. Storage bottle 12 may be any jar or wide mouthed bottle having an open upper end 18. Bottle 12 has a floor 20 and a lateral wall 22 which define a receptacle 24 there within. Floor 20 and wall 22 are sufficiently flexible to deform when squeezed or constricted by hand. Bottle 12 may be molded as part of container 10, or alternatively, pre-existing bottles may be incorporated into the invention by fabricating only auxiliary vessel 14 and cap 16 to conform to dimensions and configuration of the pre-existing bottle.

Auxiliary vessel 14 is dimensioned and configured to cooperate with and be insertable into and retained within storage bottle 12, occupying receptacle 24. Vessel 14 includes a hollow storage portion 26 having an interior storage space 28, a mixing chamber 30 having a peripheral wall 32 and an open top 34, and a barrier 36 separating space 28 from mixing chamber 30. Cap 16 is dimensioned and configured to close open top 34. Cap 16 has threads (not shown) or alternatively friction fits to open top 34 of auxiliary vessel 14 to enable secure closure. Cap 16 may have openable pouring apertures or spouts as are conventionally found on shampoo bottles and the like. Storage portion 26 is dimensioned and configured to leave unoccupied space within receptacle 24 between storage portion 26 and wall 22 of bottle 12 when bottle 12 is undistorted by squeezing or constricting.

It will be seen that barrier 36 extends laterally beyond storage portion 26, and is dimensioned and configured to close open end 18 of storage bottle 12. To this end, auxiliary vessel 12 includes a skirt 38 bearing threads 40 which are matingly compatible with threads 42 formed in bottle 12. Barrier 36 has a first check valve 44 enabling passage of fluids from storage space 28 into mixing chamber 30, and second check valves 46, 48 enabling passage of fluids from receptacle 24 of storage bottle 12 into mixing chamber 30. Valves 44, 46, 48 are preferably flaccid membrane valves which distend to pass fluids upwardly, in the depiction of FIG. 1, but which will collapse and seal themselves responsive to relatively high pressure developing within chamber 30. The membrane valves may be formed integrally with barrier 36, or alternatively may be formed separately therefrom.

Agitating members 50 are optionally contained within mixing chamber 30. Agitating members 50 are preferably heavy balls which promote blending by agitation when fluids are ejected from storage space 28 and from receptacle 24 into mixing chamber 30. If the separate fluids are miscible, the agitating members may be omitted. A mesh (not shown) ma y also be included to prevent the balls 50 from escaping during pouring.

Figure 2:
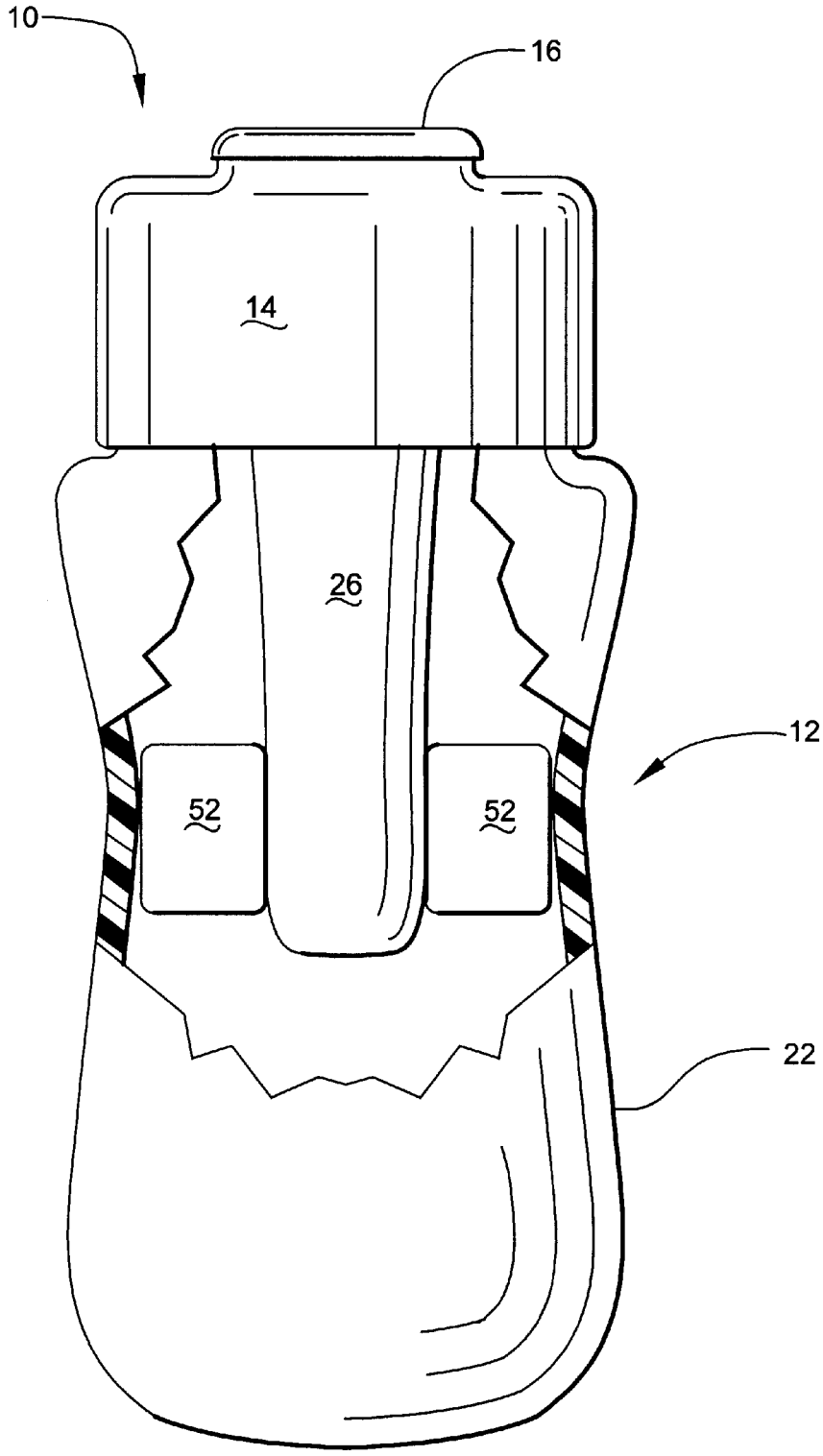
FIG. 2 is a side elevational view of an embodiment of the invention including an optional pressure transfer member and depicting deformation from squeezing, shown partially broken away to reveal internal detail.

Turning now to FIG. 2, storage bottle 12 is shown deformed as would occur when a person squeezes bottle 12. Optional compression resistant members 52 located inside receptacle 24 of bottle 12 transfer pressure from squeezing to storage portion 26 of auxiliary vessel 14. It will be seen that storage portion 26 is in turn deformed by pressure transferred by members 52. Transfer of pressure assures that squeezing ejects fluids from both bottle 12 and also storage space 28. This may be necessary in cases wherein, for example, the fluid contained within storage space 28 is highly viscous, and would resist pressure brought to bear on storage portion 26. Compression members 52 need not be totally rigid. They merely need be more rigid than wall 22 of bottle 12 and storage portion 26 of vessel 14. Compression members 52 may be, for example, cubes of resilient plastic or rubber material joined to one another in series and sufficiently spaced apart to allow egress to fluid contained within receptacle 24.

Figure 3:
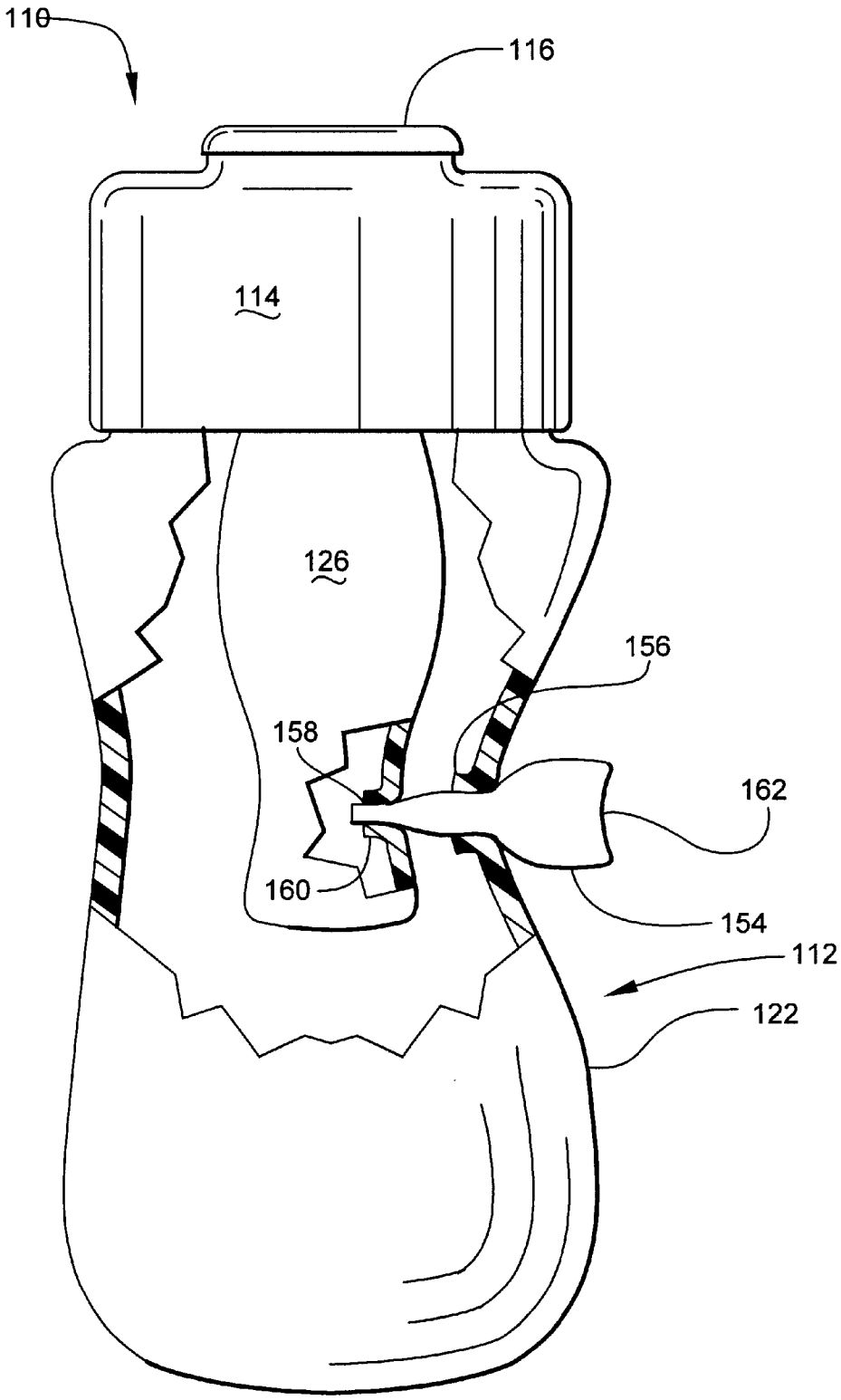
FIG. 3 is a side elevational view of an embodiment of the invention showing optional recharging of an interior auxiliary vessel, partially broken away to reveal internal detail.

Turning now to FIG. 3, there is shown a recharging vessel 154, which is utilized to recharge storage portion 126 of auxiliary vessel 114. In the embodiment of FIG. 3, container 110 is in many ways similar to the embodiment of FIG. 1, with exceptions relating to cooperation with recharging vessel 154. Storage bottle 112 is modified from its counterpart of FIG. 1 in that it has an inlet port 156 formed in lateral wall 122. Inlet port 156 may comprise, for example, a membrane check valve similar in operation to valves 44, 46, 48 of FIG. 1. Recharging vessel 154 has a nozzle 158 which passes through inlet valve 156 and through a similar inlet valve 160 formed in storage portion 126 of auxiliary vessel 114.

Recharging vessel 154 may then discharge its contents into storage portion 126. This may be done by squeezing vessel 154 by pressing on floor 162, as depicted in FIG. 3. Alternatively, vessel 154 may have an independent source of propellant (not shown) or other means of ejecting its contents on demand.

It should be noted that inlet ports 156, 160 are mutually alignable so that nozzle 158 can readily engage inlet port 160. This is accomplished firstly by causing bottle 112 and auxiliary vessel 114 to be dimensioned and configured such that inlet ports 156, 160 are at equal heights when auxiliary vessel 114 fully engages bottle 112, and secondly by providing means for assuring that auxiliary vessel be appropriately rotated (if threaded) relative to bottle 112. Visual means such as molded index marks (not shown) may be formed in both bottle 112 and in auxiliary vessel 114 to indicate correct alignment.

Progressive depletion of fluids stored in the various receptacles of all embodiments may be accommodated in any suitable way. Air relief valves (not shown) may be incorporated where desired. A source of compressed gas may be provided to prevent collapse or inoperability upon depletion of stored fluids. Alternatively, because bottles 12 and 112 and auxiliary vessels 14 and 114 are flexible, they may be allowed to deform in controlled fashion as their contents are removed by squeezing, and to remain in the deformed state until subsequently refilled.

The present invention is susceptible to variations and modifications which may be introduced thereto without departing from the inventive concept. For example, compression members 52 (see FIG. 2) may be integral with bottle 12 if desired, or alternatively, may be loosely fitted. Also, it will be obvious to one skilled in the art that proper air vents could be added so as to relieve vacuum and allow return of the deformed bottles to their original shape.

It is to be understood that the present invention is not limited to the embodiments described above, but encompasses any and all embodiments within the scope of the following claims.

I claim:

1. A dispensing container for storing fluids separately and blending and dispensing these fluids, comprising:

a storage bottle having a floor, a lateral wall, an open upper end, and a receptacle defined within said lateral wall and said floor;

an auxiliary vessel dimensioned and configured to cooperate with and be insertable into and retained within said receptacle of said storage bottle, wherein said auxiliary vessel has a hollow storage portion enclosing an interior storage space, a mixing chamber having a peripheral wall, and a barrier separating said interior storage space from said mixing chamber, wherein said barrier extends laterally beyond said storage portion and is dimensioned and configured to close said open end of said storage bottle, and has at least one first check valve enabling passage of fluid from said interior storage space to said mixing chamber and at least one second check valve enabling passage of fluid from said receptacle of said storage bottle to said mixing chamber; and a cap dimensioned and configured to close said mixing chamber.

2. The dispensing container according to claim 1, wherein each said first check valve is a flaccid membrane valve.

3. The dispensing container according to claim 1, wherein each said second check valve is a flaccid membrane valve.

4. The dispensing container according to claim 1, further comprising a plurality of agitating members disposed within said mixing chamber.

5. The dispensing container according to claim 4, wherein said agitating members are balls.

6. The dispensing container according to claim 1, further including compression resistant members located inside said receptacle of said storage bottle, disposed to transfer pressure from squeezing to said auxiliary vessel.

7. The dispensing container according to claim 1, further including a recharging vessel having a nozzle, wherein said lateral wall of said storage bottle has a first inlet port and said auxiliary vessel has a second inlet port alignable with said first inlet port, and said nozzle is disposed to pass through said first inlet port of said lateral wall of said storage bottle, to communicate with said second inlet port of said auxiliary vessel, and to recharge said auxiliary vessel.

8. The dispensing container according to claim 1, wherein said storage portion of said auxiliary vessel is dimensioned and configured to leave unoccupied space between said auxiliary vessel and said lateral wall of said storage bottle.

9. A dispensing container for storing fluids separately and blending and dispensing these fluids, comprising:

a storage bottle having a floor, a lateral wall, an open upper end, and a receptacle defined within said lateral wall and said floor;

an auxiliary vessel dimensioned and configured to cooperate with and be insertable into and retained within said receptacle of said storage bottle, wherein said auxiliary vessel has a hollow storage portion enclosing an interior storage space, wherein said storage portion of said auxiliary vessel is dimensioned and configured to leave unoccupied space between said auxiliary vessel and said lateral wall of said storage bottle, a mixing chamber having a peripheral wall and a plurality of agitating balls disposed within said mixing chamber, and a barrier separating said interior storage space from said mixing chamber, wherein said barrier extends laterally beyond said storage portion and is dimensioned and configured to close said open end of said storage bottle, and has at least one first check valve in the form of a flaccid membrane valve enabling passage of fluid from said interior storage space to said mixing chamber and at least one second check valve in the form of a flaccid membrane valve enabling passage of fluid from said receptacle of said storage bottle to said mixing chamber; and cap dimensioned and configured to close said mixing chamber.

10. A dispensing container for storing fluids separately and blending and dispensing these fluids, comprising:

a storage bottle having a floor, a lateral wall, an open upper end, and a receptacle defined within said lateral wall and said floor;

an auxiliary vessel dimensioned and configured to cooperate with and be insertable into and retained within said receptacle of said storage bottle, wherein said auxiliary vessel has a hollow storage portion enclosing an interior storage space, wherein said storage portion of said auxiliary vessel is dimensioned and configured to leave unoccupied space between said auxiliary vessel and said lateral wall of said storage bottle, a mixing chamber having a peripheral wall, and a barrier separating said interior storage space from said mixing chamber, wherein said barrier extends laterally beyond said storage portion and is dimensioned and configured to close said open end of said storage bottle, and has at least one first check valve in the form of a flaccid membrane valve enabling passage of fluid from said interior storage space to said mixing chamber and at least one second check valve in the form of a flaccid membrane valve enabling passage of fluid from said receptacle of said storage bottle to said mixing chamber; and a cap dimensioned and configured to close said mixing chamber, wherein said storage bottle includes compression resistant members located inside said receptacle of said storage bottle, disposed to transfer pressure from squeezing to said auxiliary vessel.

11. The dispensing container according to claim 10, further comprising a plurality of agitating balls disposed within said mixing chamber.

12. A dispensing container for storing fluids separately and blending and dispensing these fluids, comprising:

a storage bottle having a floor, a lateral wall, an open upper end, and a receptacle defined within said lateral wall and said floor;

an auxiliary vessel dimensioned and configured to cooperate with and be insertable into and retained within said receptacle of said storage bottle, wherein said auxiliary vessel has a hollow storage portion enclosing an interior storage space, wherein said storage portion of said auxiliary vessel is dimensioned and configured to leave unoccupied space between said auxiliary vessel and said lateral wall of said storage bottle, a mixing chamber having a peripheral wall, and a barrier separating said interior storage space from said mixing chamber, wherein said barrier extends laterally beyond said storage portion and is dimensioned and configured to close said open end of said storage bottle, and has at least one first check valve in the form of a flaccid membrane valve enabling passage of fluid from said interior storage space to said mixing chamber and at least one second check valve in the form of a flaccid membrane valve enabling passage of fluid from said receptacle of said storage bottle to said mixing chamber;

a cap dimensioned and configured to close said mixing chamber; and a recharging vessel having a nozzle, wherein said lateral wall of said storage bottle has a first inlet port and said auxiliary vessel has a second inlet port alignable with said first inlet port, and said nozzle is disposed to pass through said first inlet port of said lateral wall of said storage bottle, to communicate with said second inlet port of said auxiliary vessel, and to recharge said auxiliary vessel.

* * * * *